US010123595B2

(12) United States Patent
Machini

(10) Patent No.: US 10,123,595 B2
(45) **Date of Patent: *Nov. 13, 2018**

(54) INTERCHANGEABLE JEWELRY SETTING SYSTEM

(71) Applicant: Joseph Machini, Hollywood, FL (US)

(72) Inventor: Joseph Machini, Hollywood, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/263,130

(22) Filed: Sep. 12, 2016

(65) Prior Publication Data

US 2017/0055645 A1 Mar. 2, 2017

Related U.S. Application Data

(62) Division of application No. 14/805,206, filed on Jul. 21, 2015, now Pat. No. 9,468,269, which is a division of application No. 14/153,707, filed on Jan. 13, 2014, now Pat. No. 9,113,681.

(60) Provisional application No. 61/751,483, filed on Jan. 11, 2013.

(51) Int. Cl.
*A44C 9/00* (2006.01)
*A44C 17/02* (2006.01)

(52) U.S. Cl.
CPC ..... *A44C 9/003* (2013.01); *A44C 9/0053* (2013.01); *A44C 17/0208* (2013.01)

(58) Field of Classification Search
CPC ..... A44C 9/0007; A44C 9/0015; A44C 9/003; A44C 17/0208
See application file for complete search history.

(56) References Cited

U.S. PATENT DOCUMENTS

| | | | | | |
|---|---|---|---|---|---|
| 891,161 | A | | 6/1908 | Goodwin | |
| 1,121,296 | A | * | 12/1914 | Schmidt | A44C 9/00 63/15.7 |
| 1,152,340 | A | * | 8/1915 | Obsboum | A44C 9/00 63/15.7 |
| 1,596,642 | A | * | 8/1926 | Weber | A44C 9/00 63/15.4 |
| 2,220,408 | A | | 11/1940 | Kalina | |
| D203,792 | S | * | 2/1966 | Mills | 63/29.1 |
| 3,933,011 | A | | 1/1976 | DiGilio et al. | |
| 4,742,696 | A | | 5/1988 | Jenkins | |

(Continued)

FOREIGN PATENT DOCUMENTS

WO 2014110501 A3 4/2015

OTHER PUBLICATIONS

International Preliminary Report on Patentability for International Application PCT/US2014/011281, Report dated Jul. 14, 2015, dated Jul. 23, 2015, 8 Pgs.

(Continued)

*Primary Examiner* — Emily M Morgan
(74) *Attorney, Agent, or Firm* — KPPB LLP

(57) ABSTRACT

An interchangeable jewelry setting system that allows for the insertion, removal and replacement of ornamental elements onto a jewelry piece is provided. The jewelry piece may comprise any type of or piece of jewelry onto which an ornamental setting may be fitted such as, for example, a ring, necklace, earring, bracelet, broach, pin, etc. Likewise, any ornamental element may be disposed on the interchangeable setting of the invention, such as, for example, a metallic engraving, ornamental design element, etc.

4 Claims, 4 Drawing Sheets

(56) References Cited

U.S. PATENT DOCUMENTS

| | | | | |
|---|---|---|---|---|
| 4,794,766 | A | 1/1989 | Schunk et al. | |
| 4,905,482 | A | 3/1990 | Gheblikian | |
| 5,228,317 | A | 7/1993 | Hendricks | |
| 5,253,490 | A * | 10/1993 | Doganay | A44C 9/0023 63/15 |
| 5,375,434 | A | 12/1994 | Wertheimer et al. | |
| 5,419,158 | A * | 5/1995 | Sandberg | A44C 9/0046 63/15.1 |
| 5,456,095 | A | 10/1995 | Tawil et al. | |
| 5,669,241 | A * | 9/1997 | Kohl | A44C 9/0015 63/15.1 |
| 6,318,122 | B1 * | 11/2001 | Burgard | A44C 9/00 63/15 |
| 6,715,315 | B1 | 4/2004 | Hartgrove | |
| 8,661,848 | B2 | 3/2014 | Bisserier | |
| 9,113,681 | B2 | 8/2015 | Machini | |
| 9,468,269 | B2 | 10/2016 | Machini | |
| 2004/0177647 | A1 * | 9/2004 | Dennis | A44C 17/0208 63/29.1 |
| 2005/0126223 | A1 | 6/2005 | Maschio | |
| 2012/0011888 | A1 * | 1/2012 | Patterson | A44C 9/003 63/15 |
| 2012/0198887 | A1 | 8/2012 | Bisserier | |
| 2013/0019635 | A1 | 1/2013 | Patterson | |
| 2013/0074547 | A1 * | 3/2013 | Nhaissi | A44C 17/0225 63/15.45 |
| 2014/0196500 | A1 | 7/2014 | Machini | |
| 2015/0320155 | A1 | 11/2015 | Machini et al. | |

OTHER PUBLICATIONS

International Search Report and Written Opinion for International Application No. PCT/US2014/011281, Search completed Jan. 22, 2015, dated Feb. 2, 2015, 11 Pgs.

* cited by examiner

FIG. 7
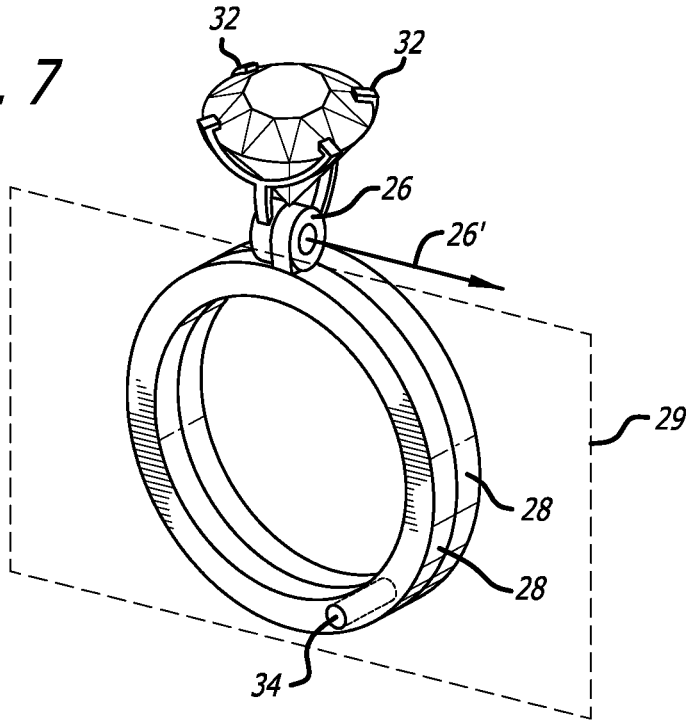
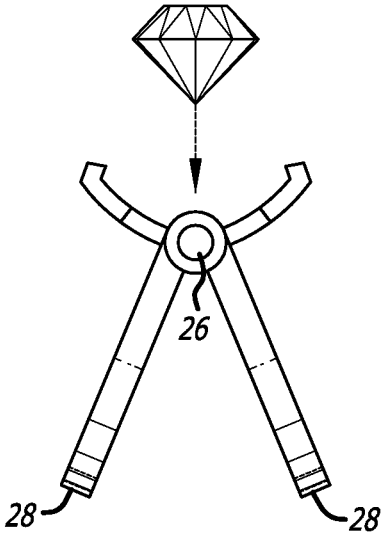
FIG. 8
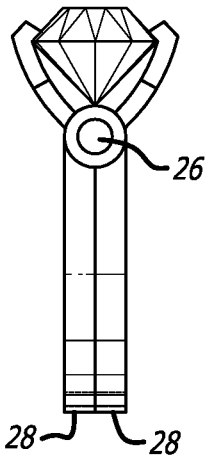
FIG. 9

FIG. 10
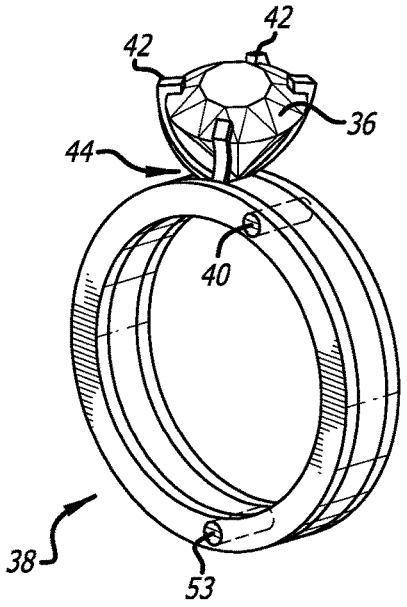
FIG. 11
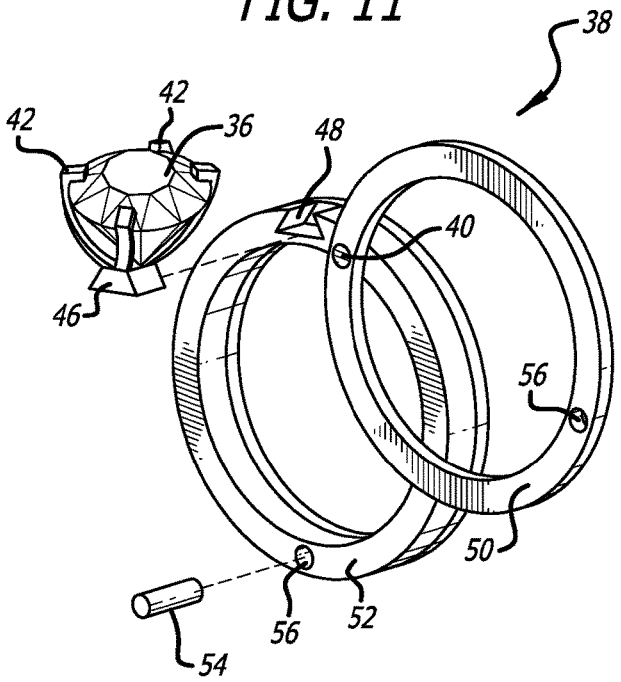
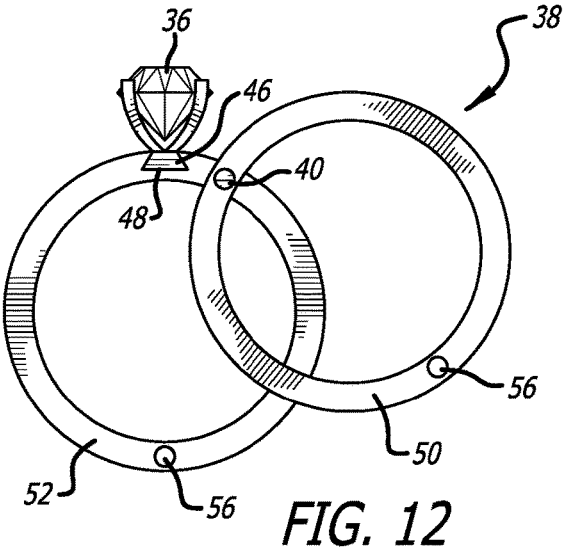
FIG. 12
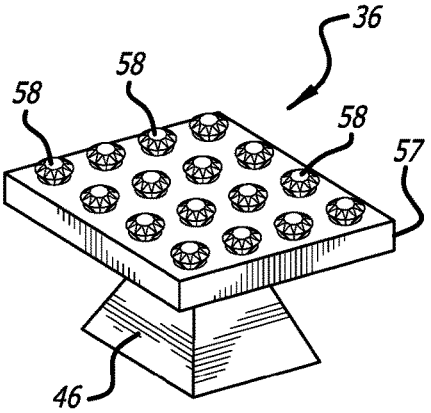
FIG. 13

INTERCHANGEABLE JEWELRY SETTING SYSTEM

CROSS-REFERENCE TO RELATED APPLICATIONS

This application is a divisional application of U.S. patent application Ser. No. 14/805,206, filed Jul. 21, 2015, which application is a divisional application of U.S. application Ser. No. 14/153,707, filed Jan. 13, 2014, which application claimed priority to U.S. Provisional Patent Application No. 61/751,483, filed Jan. 11, 2013, the disclosures of which are incorporated herein by reference.

FIELD OF THE INVENTION

Interchangeable jewelry settings, and specifically jewelry settings incorporating mechanisms allowing the ornamental portion of the ring attached to the setting to be interchanged are provided.

BACKGROUND OF THE INVENTION

Although there are a large variety of jewelry designs, most include some sort of a central ornamental piece, such as a gemstone, disposed in a setting, possibly including another aesthetic design element (e.g. engraving, finish, etc.). In most cases, the setting, including the gemstone or whatever other ornamental element is included with or on the setting are fashioned in such a way that they form a single unchangeable piece. In other words, ornamental element is permanently attached to the setting and the setting, in turn, is permanently attached to the rest of the jewelry piece.

Various enhancements to this type of permanent jewelry settings have been proposed previously. These include examples of jewelry in which the ornamental elements, such as the gemstone, are engage by a clasping mechanism. Examples of such designs may be found in U.S. Pat. No. 5,375,434 Wertheimer (1994), U.S. Pat. No. 4,794,766 Schunk et al. (1989), and U.S. Pat. No. 4,742,696 Jenkins (1988). However, these designs typically include a separate hinged gemstone holder that puts a number of constraints on the ornamental appearance of the jewelry piece. Other prior art focuses on the interchangeability of larger sections of the ring, such as the setting itself. Examples of these types of designs may be found in U.S. Pat. No. 3,933,011 DiGillio et al. (1976), U.S. Pat. No. 5,456,095 Tawil et al. (1995), U.S. Pat. No. 4,905,482 Gheblikian (1990) and U.S. Pat. No. 5,228,317 Hendricks (1993). These all provide variations on either a keyed or directly grasping mechanism in which the setting may be replaced. However, all have a tendency to require a number of intricate mechanisms that makes these jewelry pieces difficult to manufacture. In addition, many of these designs can add substantial bulk to the jewelry piece, thus the limiting the design flexibility of these pieces.

SUMMARY OF THE INVENTION

The current application describes embodiments of an interchangeable jewelry setting system that allow for the insertion, removal and replacement of ornamental elements onto a jewelry piece.

In some embodiments, the invention is directed to a jewelry piece, such as a ring, having an interchangeable setting system including:

a plurality of independent ring portions each comprising at least a passage through which a wearer's finger may be inserted, the independent ring portions being rotatably interconnected such that the passages of the independent ring portions may be rotated into and out of alignment;

an anchor mechanism for securing an ornamental element to said ring comprising a plurality of armatures, wherein at least one armature is disposed on each of said independent ring portions; and wherein the plurality of armatures are configured such that where the passages of each of the plurality of independent ring portions are rotated into alignment the anchor mechanism secures the ornamental element to said ring, and where the passages of each of the plurality of independent ring portions are rotated out of alignment the anchor mechanism releases the ornamental element such that it may be removed from the ring.

In other embodiments, the jewelry includes at least three rotatably interconnected independent ring portions, each having at least one armature disposed thereon.

In still other embodiments, the jewelry includes at least four rotatably interconnected independent ring portions, each having at least one armature disposed thereon.

In yet other embodiments, each of the independent ring portions defined a plane orthogonal to the axis of rotation, and wherein the independent ring portions are disposed such that they rotate about said axis within said plane.

In still yet other embodiments, each of the independent ring portions defined a plane parallel to the axis of rotation, and wherein the independent ring portions are disposed such that they rotate about said axis out of said plane.

In still yet other embodiments, the ornamental element is selected from the group consisting of a loose gem, a set gem, a plurality of gems, a plurality of set gems, a metallic engraving, and an ornamental design element.

In still yet other embodiments, the jewelry includes a locking mechanism for securing the independent ring portions against rotation. In one such embodiment, the locking mechanism comprises a plurality of channels formed in said independent ring portions and a pin sized to be inserted within said plurality of channels, wherein the plurality of channels are configured such that when the passages of the independent ring portions are aligned the plurality of channels are aligned.

In some embodiments, the invention is directed to a jewelry piece, such as a ring, having an interchangeable setting system including:

a plurality of independent ring portions each comprising at least a passage through which a wearer's finger may be inserted, the independent ring portions being rotatably interconnected such that the passages of the independent ring portions may be rotated into and out of alignment;

an anchor mechanism for securing an ornamental element to said ring comprising a plurality of armatures, wherein at least one armature is disposed on each of said independent ring portions;

wherein the plurality of armatures are configured such that where the passages of each of the plurality of independent ring portions are rotated into alignment the anchor mechanism secures the ornamental element to said ring, and where the passages of each of the plurality of independent ring portions are rotated out of alignment the anchor mechanism releases the ornamental element such that it may be removed from the ring; and wherein each of the independent ring portions defined a plane orthogonal to the axis of rotation, and wherein the independent ring portions are disposed such that they rotate about said axis within said plane.

In other embodiments, the jewelry includes at least three rotatably interconnected independent ring portions, each having at least one armature disposed thereon.

In still other embodiments, the jewelry includes at least four rotatably interconnected independent ring portions, each having at least one armature disposed thereon.

In yet other embodiments, the ornamental element is selected from the group consisting of a loose gem, a set gem, a plurality of gems, a plurality of set gems, a metallic engraving, and an ornamental design element.

In still yet other embodiments, the jewelry includes a locking mechanism for securing the independent ring portions against rotation. In one such embodiment, the locking mechanism includes a plurality of channels formed in said independent ring portions and a pin sized to be inserted within said plurality of channels, wherein the plurality of channels are configured such that when the passages of the independent ring portions are aligned the plurality of channels are aligned.

In some embodiments, the invention is directed to a jewelry piece, such as a ring, having an interchangeable setting system including:

a plurality of independent ring portions each comprising at least a passage through which a wearer's finger may be inserted, the independent ring portions being rotatably interconnected such that the passages of the independent ring portions may be rotated into and out of alignment;

an anchor mechanism for securing an ornamental element to said ring comprising a plurality of armatures, wherein at least one armature is disposed on each of said independent ring portions;

wherein the plurality of armatures are configured such that where the passages of each of the plurality of independent ring portions are rotated into alignment the anchor mechanism secures the ornamental element to said ring, and where the passages of each of the plurality of independent ring portions are rotated out of alignment the anchor mechanism releases the ornamental element such that it may be removed from the ring; and wherein each of the independent ring portions defined a plane parallel to the axis of rotation, and wherein the independent ring portions are disposed such that they rotate about said axis out of said plane.

In other embodiments, the ornamental element is selected from the group consisting of a loose gem, a set gem, a plurality of gems, a plurality of set gems, a metallic engraving, and an ornamental design element.

In some embodiments, the invention is directed to a jewelry piece, such as a ring, having an interchangeable setting system including:

a plurality of independent ring portions each comprising at least a passage through which a wearer's finger may be inserted, the independent ring portions being rotatably interconnected such that the passages of the independent ring portions may be rotated into and out of alignment;

a removable ornamental element having a interlocking portion disposed thereon;

an anchor mechanism for securing the ornamental element to said ring comprising a slot configured to cooperatively engage the interlocking portion of the ornamental element, the slot having a slot opening formed in at least one of said independent ring portions and a slot closure formed in at least another of said independent ring portions; and wherein the slot and closure are configured such that where the passages of each of the plurality of independent ring portions are rotated into alignment the closure closes said slot opening securing the interlocking portion of the ornamental element within the slot, and where the passages of each of the plurality of independent ring portions are rotated out of alignment the slot opening is exposed such that the interlocking portion of the ornamental element may be removed from the slot.

In other embodiments, each of the independent ring portions defined a plane orthogonal to the axis of rotation, and wherein the independent ring portions are disposed such that they rotate about said axis within said plane.

In still other embodiments, the ornamental element is selected from the group consisting of a loose gem, a set gem, a plurality of gems, a plurality of set gems, a metallic engraving, and an ornamental design element.

In still yet other embodiments, the jewelry includes a locking mechanism for securing the independent ring portions against rotation comprising a plurality of channels formed in said independent ring portions and a pin sized to be inserted within said plurality of channels, wherein the plurality of channels are configured such that when the passages of the independent ring portions are aligned the plurality of channels are aligned.

BRIEF DESCRIPTION OF THE DRAWINGS

The description and claims of the current invention will be more fully understood with reference to the following figures, which are presented as exemplary embodiments of the invention and should not be construed as a complete recitation of the scope of the invention, wherein:

FIG. 7 provides a perspective view of an interchangeable jewelry setting system in accordance with yet another embodiment of the invention;

FIG. 8 provides a side-view of the interchangeable jewelry setting system shown in FIG. 7;

FIG. 9 provides a side-view of the interchangeable jewelry setting system shown in FIG. 7;

FIG. 10 provides a perspective view of an interchangeable jewelry setting system in accordance with an embodiment of the invention;

FIG. 11 provides a perspective view of the interchangeable jewelry setting system shown in FIG. 10;

FIG. 12 provides a front-view of the interchangeable jewelry setting system shown in FIG. 10; and FIG. 13 provides a perspective view of an interchangeable jewelry setting in accordance with an embodiment of the invention.

DETAILED DESCRIPTION OF THE INVENTION

In accordance with the figures and descriptions, embodiments of an interchangeable jewelry setting system that allows for the insertion, removal and replacement of ornamental elements onto a jewelry piece are provided. With respect to the following detailed description, although only a ring is shown, it will be understood that the jewelry piece may comprise any type of or piece of jewelry onto which an ornamental setting may be fitted such as, for example, a ring, necklace, earring, bracelet, broach, pin, etc. Likewise, although the ornamental element in the following description is shown to be a gemstone, it will be understood that any ornamental element may be disposed on the interchangeable setting of the invention, such as, for example, a metallic engraving, ornamental design element, etc.

Figure 1:
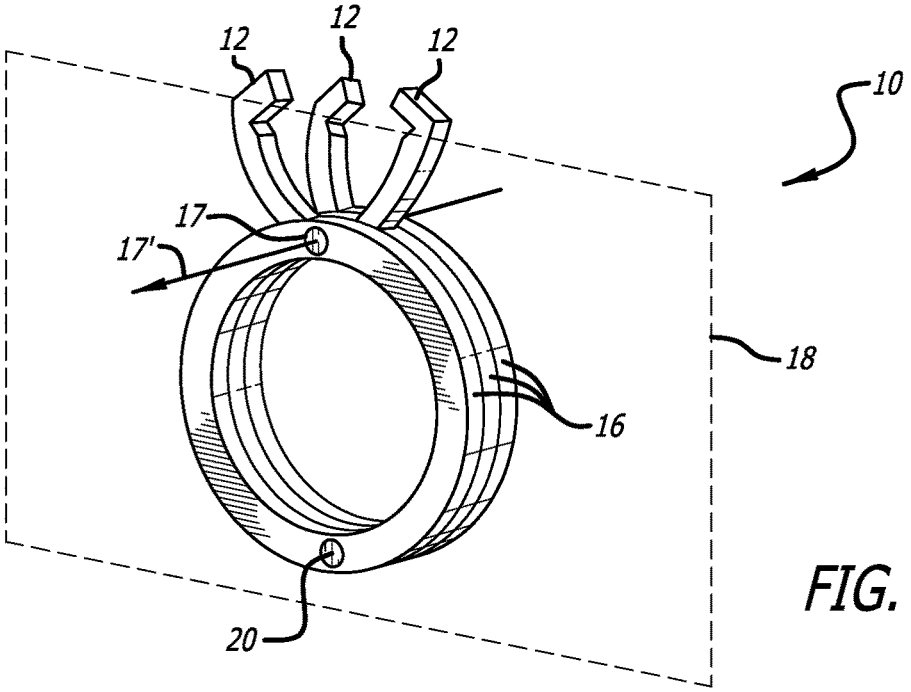
FIG. 1 provides a perspective view of an interchangeable jewelry setting system in accordance with an embodiment of the invention.
Figure 2:
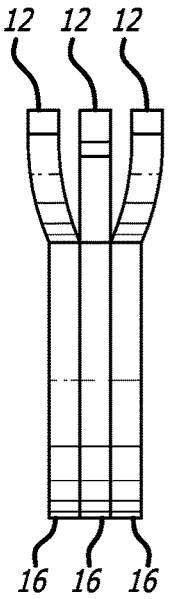
FIG. 2 provides a side-view of the interchangeable jewelry setting system shown in FIG. 1.
Figure 3:
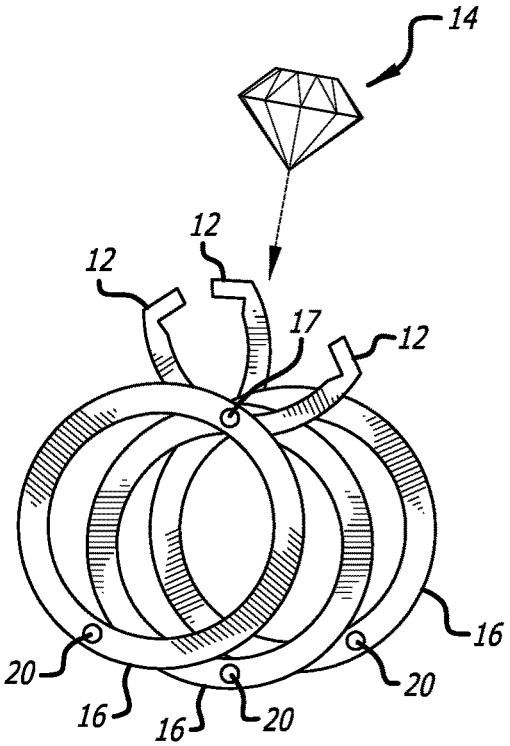
FIG. 3 provides a front-view of the interchangeable jewelry setting system shown in FIG. 1.

Turning now to the diagrams, FIGS. 1 to 3 show an interchangeable jewelry setting system (10) according to certain embodiments of the invention. As shown, in these embodiments the system includes an ornamental anchor mechanism that comprises a plurality of armatures (12) for directly grasping either the setting or, as shown in the figures, the ornamental element (14). The anchor mechanism, in the form of the armatures in such embodiments, is disposed across the independent portions or portions (16) of the jewelry piece, which themselves are interconnected through a rotatable interconnection (17) that defines a rotational axis (17'). The rotation of the may be described by how the rotational axis is arranged in relation to a plane (18) formed by the face of the jewelry piece and each of the independent portions. In the embodiment shown in FIGS. 1 to 3 the plane (18) is orthogonal to the rotational axis (17') such that the independent portions (16) are rotatable relative to each other about said interconnection (as shown in FIG. 3) within said orthogonal plane (18).

Although the anchor mechanism may take many forms, as will be described in detail by reference to the various embodiments, in the embodiment shown in FIGS. 1 to 3, the armatures (12) are cooperatively arranged on said independent portions (16) such that during operation, when the independent portions are rotated the armatures (12) move relative to each other, thereby releasing and allowing the interchange of the ornamental element (14). In particular in one embodiment the rotation can be defined in relation to the alignment of the passage formed in each of the independent portions (16) for the wearer's finger, wherein when these passages are aligned (as shown in FIG. 1) the armatures (12) of the anchoring mechanism are positioned to secure the ornamental element in the ring, and wherein when these passages are out of alignment (as shown in FIG. 3) the armatures of the anchoring mechanism open to allow removal of the ornamental element from the ring.

To avoid the inadvertent rotation of the elements a securing mechanism may be provided, such as a pin (19), which can be placed through a hole (20) on each of the independent portions to prevent their moving relative to each other. Although the jewelry piece in these embodiments is shown to be a ring, it should be understood that a similar independently rotating mechanism may be used in any type of jewelry piece. However, where the jewelry piece is a ring, it should be understood that the independent portions (16) could take the form of separate cross-sections of the ring of any suitable number that when combined form full body of the ring. In such a case, a secondary securing mechanism would be the wearer's finger, which when inserted through the three aligned sections of the ring would prevent the sections from rotating apart. Likewise, although the ring is shown to have a circular design in the figure, it should be understood that any shaped ring may be used in association with the invention, including square, tapered, or irregular. In addition, the independent portions (12) may each take a different shape where desired.

Figure 4:
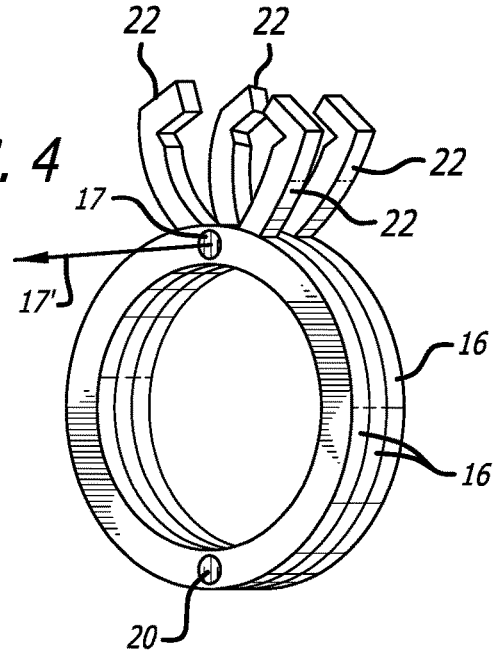
FIG. 4 provides a perspective view of an interchangeable jewelry setting system in accordance with another embodiment of the invention.
Figure 5:
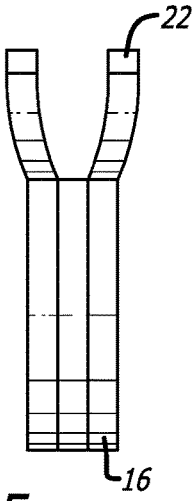
FIG. 5 provides a side-view of the interchangeable jewelry setting system shown in FIG. 4.
Figure 6:
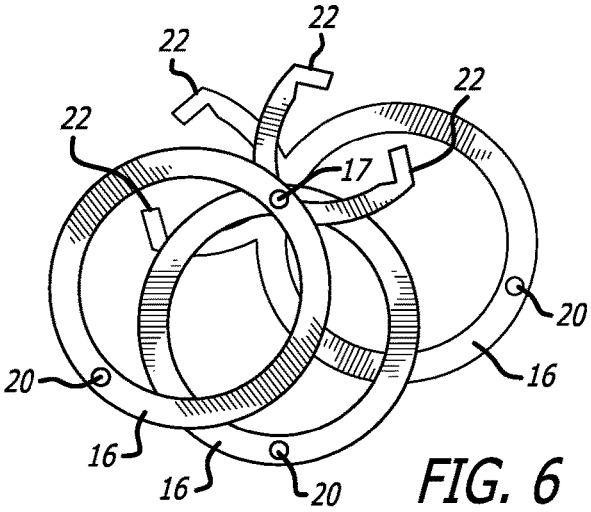
FIG. 6 provides a front-view of the interchangeable jewelry setting system shown in FIG. 4.

Although the FIGS. 1 to 3 present embodiments having three rotating armatures, it should be understood that the anchoring mechanism in such examples might include additional armatures. For example, FIGS. 4 to 6 show embodiments of the invention where the anchor mechanism incorporates four separate rotating armatures (22). Apart from the number of armatures, such a mechanism would function as described above, and could also include all the possible variations and securing mechanisms described above.

In the embodiments shown in FIGS. 1 to 6, the rotatable interconnection (17), about which the independent elements or portions (16) of the jewelry piece (10) rotate, is oriented and arranged such that the individual portions of the jewelry piece each rotate radially about the interconnection within a vertical plane (18') that is orthogonal to the interconnection. However, as shown in FIGS. 7 to 9, in some embodiments of the invention the rotatable interconnection (26) may be oriented such that the axis of rotation (26') about which the independent elements or portions of the ring (28) rotate is parallel to the plane (29) that the face of the jewelry piece and each of the independent portions define such that the individual portions (30) and interconnected armatures (32) (which in this embodiment collectively form the anchoring mechanism) pivot out and upward. As shown in FIG. 8, this type of arrangement results in a pincer movement such as would be obtained with a pair of pliers. Again, in one embodiment the rotation can be defined in relation to the alignment of the passage formed in each of the independent portions (26) for the wearer's finger, wherein when these passages are aligned (as shown in FIG. 7) the armatures (32) of the anchoring mechanism are positioned to secure the ornamental element in the ring, and wherein when these passages are out of alignment (as shown in FIG. 8) the armatures of the anchoring mechanism open to allow removal of the ornamental element from the ring.

Although four grasping armatures (32) are shown in FIG. 7, any suitable number of grasping armatures might be disposed on the independent elements or portions of the jewelry piece to collectively form the anchoring mechanism. Likewise, as shown in FIG. 7, these embodiments may also incorporate a securing mechanism (34) such as a pin that when slotted between the independent portions of the jewelry piece prevent their motion relative to each other.

Finally although the above discussion describes embodiments of the invention in which the anchoring mechanism comprises a plurality of armatures that cooperatively hold the setting or ornamental element, and which are directly attached to the independent portions of the jewelry piece, and in turn directly grasp the ornamental element, in other embodiments, as shown in FIGS. 10 to 12, the entire setting (and the grasping armatures) (36) could be interchangeable. As shown, in such an embodiment the independent portions of the jewelry piece (38) are interconnected through a rotating link (40), such that they are rotatable relative to each other radially about said link (as shown in FIGS. 11 and 12). In turn, the grasping or setting assembly (36) consists of grasping armatures (42) and an anchoring mechanism (44).

During operation, when the independent portions are rotated apart (as shown in either FIG. 11 or 12), the anchoring mechanism (44) is unlocked thereby releasing and allowing the interchange of the setting assembly.

Turning to the anchoring mechanism (44), as shown in FIG. 11, the anchoring mechanism consists of an interlocking element (46) configured to slid within a cooperative slot (48) on at least one of the independent portions of the jewelry piece. Although this interlocking element and cooperative slot are shown as forming a pair of tapered wedges, it should be understood that the interlocking shapes of the element and slot may take any form that allows for the setting (36) to be secured within the at least one of the independent portions of the jewelry piece. As shown in the figures, during use a first independent portion (50) of the jewelry piece is rotated about the link relative to the remainder of the jewelry piece thereby exposing the opening of the slot (48) disposed in the second independent portion (52) of the jewelry piece. Once the slot opening is thus exposed, the interlocking element (46) of the setting (36) may be slid out of the slot and removed from the second independent portion of the jewelry piece. Although in the embodiments shown, the interlock element is disposed on the setting and the slot on the jewelry piece, it should be understood that these elements may be reversed without affecting the operation or functionality of the invention. To avoid the inadvertent rotation of the elements relative to each other a securing mechanism (53) may be provided, such as a pin or screw (54) which can be placed through a hole (56) on each of the independent portions to prevent their moving relative to each other. In a preferred embodiment, the securing mechanism is a screw that is inserted through a threaded passageway, where the screw has a counter-sunk head such that it is flush with the outer surface of the ring itself.

It should be generally understood throughout this patent and the above description that all items are attached to relevant adjacent items by some means commensurate with the materials of which they are made (e.g. metalworking if items are made from metal). While the above description contains many specificities, these should not be construed as limitations on the scope of the invention, but rather as an exemplification of one preferred embodiment thereof. For example:

The interchangeable ornament element may or may not contain gemstones; if not, they may consist entirely of different materials (gold, silver, etc.) possibly with some other kind of design element present, for example as shown in FIG. 13 the interchangeable element (36) might include a setting (57) that itself has a plurality of gems (58) or other ornamental elements disposed thereon;

Gemstones which optionally reside in the interchangeable ring shank/ornament assemblies may be set or held in place in any fashion (e.g. prong-set, bezel-set, etc.);

Interlocking anchor and slot do not have to be of any particular shape. Rather they can be of any shape (e.g. cylindrical, hexagonal, etc.), and there can be more than one interlock/slot combination in any embodiment;

There can be more than one interchangeable setting connected to a single jewelry piece; and The securing mechanism can be replaced by any mechanism which secures the independent portions of the jewelry piece, including, for example, magnets, buttons, snaps, or latch closures.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. An interchangeable jewelry setting system comprising:

a plurality of stacked independent portions, each independent portion being planar defining a single plane, each of the independent portions being rotatably interconnected about a single axis of rotation such that each of the independent portions are independently rotatable relative to each other;

a plurality of armatures wherein at least one armature is disposed on each of said independent portions such that each of the plurality of armatures are disposed substantially within the plane of its respective independent portion; the armature is independently rotatable relative to each other between a first securing position where the plurality of armatures are cooperatively arranged within a single horizontal plane to engage and immobilize an ornamental element therehetween, and a second open position wherein an opening is formed between the plurality of armatures sufficiently dimensioned to allow the removal of the ornamental element from said setting;

wherein the plurality of armatures are configured such that the plurality of planes of the independent portions are axially aligned when the plurality of armatures are in the first securing position, and wherein the plurality of planes of the independent portions are axially unaligned when the plurality of armatures are in the second open position; and wherein the plurality of planes defined by the independent portions is one of either parallel or orthogonal to the axis of rotation, and wherein the armatures and the independent portions are disposed on opposite sides of the axis of rotation, and wherein the plurality of armatures are disposed on the independent portions such that where the plurality of planes are orthogonal to the axis of rotation the armatures are configured rotate within its respective plane, and where the plurality of planes are parallel to the axis of rotation the armatures rotate out of its respective plane.

2. The setting of claim 1, comprising at least three independently rotatable interconnected independent portions, each having at least one armature disposed thereon.

3. The setting of claim 1, further comprising a locking mechanism for securing the independent portions against rotation.

4. The setting of claim 3, wherein the locking mechanism comprises a plurality of channels formed in said independent portions and a pin sized to be inserted within said plurality of channels, wherein the plurality of channels are configured such that when the plurality of planes of the independent portions are aligned the plurality of channels are aligned.

* * * * *